US011319112B2

(12) United States Patent
Hutton

(10) Patent No.: US 11,319,112 B2
(45) Date of Patent: May 3, 2022

(54) FOOD STORAGE CONTAINER

(71) Applicant: Joanne Budd Hutton, Taylorsville, UT (US)

(72) Inventor: Joanne Budd Hutton, Taylorsville, UT (US)

( * ) Notice: Subject to any disclaimer, the term of this patent is extended or adjusted under 35 U.S.C. 154(b) by 0 days.

(21) Appl. No.: 16/537,786

(22) Filed: Aug. 12, 2019

(65) Prior Publication Data

US 2020/0148421 A1 May 14, 2020

Related U.S. Application Data

(60) Provisional application No. 62/760,186, filed on Nov. 13, 2018.

(51) Int. Cl.

| | |
|---|---|
| ***B65D 25/08*** | (2006.01) |
| ***B65D 25/28*** | (2006.01) |
| ***B65D 1/22*** | (2006.01) |
| ***B65D 81/34*** | (2006.01) |
| ***B65D 43/02*** | (2006.01) |

(52) U.S. Cl.

CPC ..... *B65D 25/08* (2013.01); *B65D 1/22* (2013.01); *B65D 25/2808* (2013.01); *B65D 43/02* (2013.01); *B65D 81/3453* (2013.01)

(58) Field of Classification Search

CPC .... B65D 25/08; B65D 25/2808; B65D 25/04; B65D 1/22; B65D 43/02; B65D 81/3453; B65D 25/06

USPC ..... 220/529, 523, 532, 533

See application file for complete search history.

(56) References Cited

U.S. PATENT DOCUMENTS

| | | | | |
|---|---|---|---|---|
| 3,720,346 | A * | 3/1973 | Cypher | B65F 1/1607 220/533 |
| 5,750,967 | A * | 5/1998 | Sprauer, Jr. | A47J 36/027 219/735 |
| D407,534 | S * | 3/1999 | Howard | D34/1 |
| 8,893,915 | B2 | 11/2014 | Vargas | |
| 2003/0116572 | A1* | 6/2003 | Klock | B65D 51/1683 220/367.1 |
| 2004/0262319 | A1 | 12/2004 | Fisher | |
| 2009/0052809 | A1 | 2/2009 | Sampson | |
| 2010/0263399 | A1 | 10/2010 | Pollina et al. | |
| 2011/0215023 | A1 | 9/2011 | Archie et al. | |
| 2014/0238995 | A1* | 8/2014 | Vargas | B65D 25/06 220/523 |
| 2016/0244216 | A1* | 8/2016 | DeCarlo | B65D 43/169 |

* cited by examiner

*Primary Examiner* — Don M Anderson
*Assistant Examiner* — Elizabeth J Volz
(74) *Attorney, Agent, or Firm* — Boudwin Intellectual Property; Daniel Boudwin

(57) ABSTRACT

A food storage container is described. The food storage container includes a base with sidewalls extending upward from the base. The base and the sidewalk forming an interior volume. A plurality of tracks disposed in the base on the interior of the container. The tracks are configured to accept at least one divider therein. Dividers are placed in the container to create partitions. The container has a lip located at the top of the sidewalls. A lid may be included with the container to seal the container. In one embodiment the lid creates a waterproof seal. Handles may extend from the sidewall such that the handles can be used to carry the container.

13 Claims, 2 Drawing Sheets

FOOD STORAGE CONTAINER

CROSS REFERENCE TO RELATED APPLICATIONS

This application claims the benefit of U.S. Provisional Application No. 62/760,186 filed on Nov. 13, 2018. The above identified patent application is herein incorporated by reference in its entirety to provide continuity of disclosure.

BACKGROUND OF THE INVENTION

The present invention relates to food storage containers. More particularly, the present invention provides a dividable food storage container.

Many people have been eating healthier. This healthier diet often includes pre-making and portioning meals. This is often referred to as meal prepping. One of the major issues with meal prepping and eating healthy is trying to efficiently pack the meals into a container or a series of containers. Many times, the healthy portions of food are larger and do not fit in container. Further, different foods require different portions. This can make finding the right container extremely difficult.

Consequently, there is a need for an improvement in the art of food storage. The present invention substantially diverges in design elements from the known art while at the same time solves a problem many people face when meal prepping and storing food. In this regard the present invention substantially fulfills these needs.

SUMMARY OF THE INVENTION

The present invention provides a food storage container wherein the same can be utilized for providing convenience for the user when storing food. The food storage container comprises a base with sidewalls extending upward from the base. The base and the sidewalk forming an interior volume. A plurality of tracks is disposed in the base on the interior of the container. The tracks are configured to accept at least one divider therein. The dividers are placed in the container to create partitions. The container has a lip located at the top of the sidewalls. A lid may be included with the container to seal the container. In one embodiment, the lid creates a waterproof seal. In some embodiments, at least one handle extends from the sidewall such that the handle can be used to carry the container.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
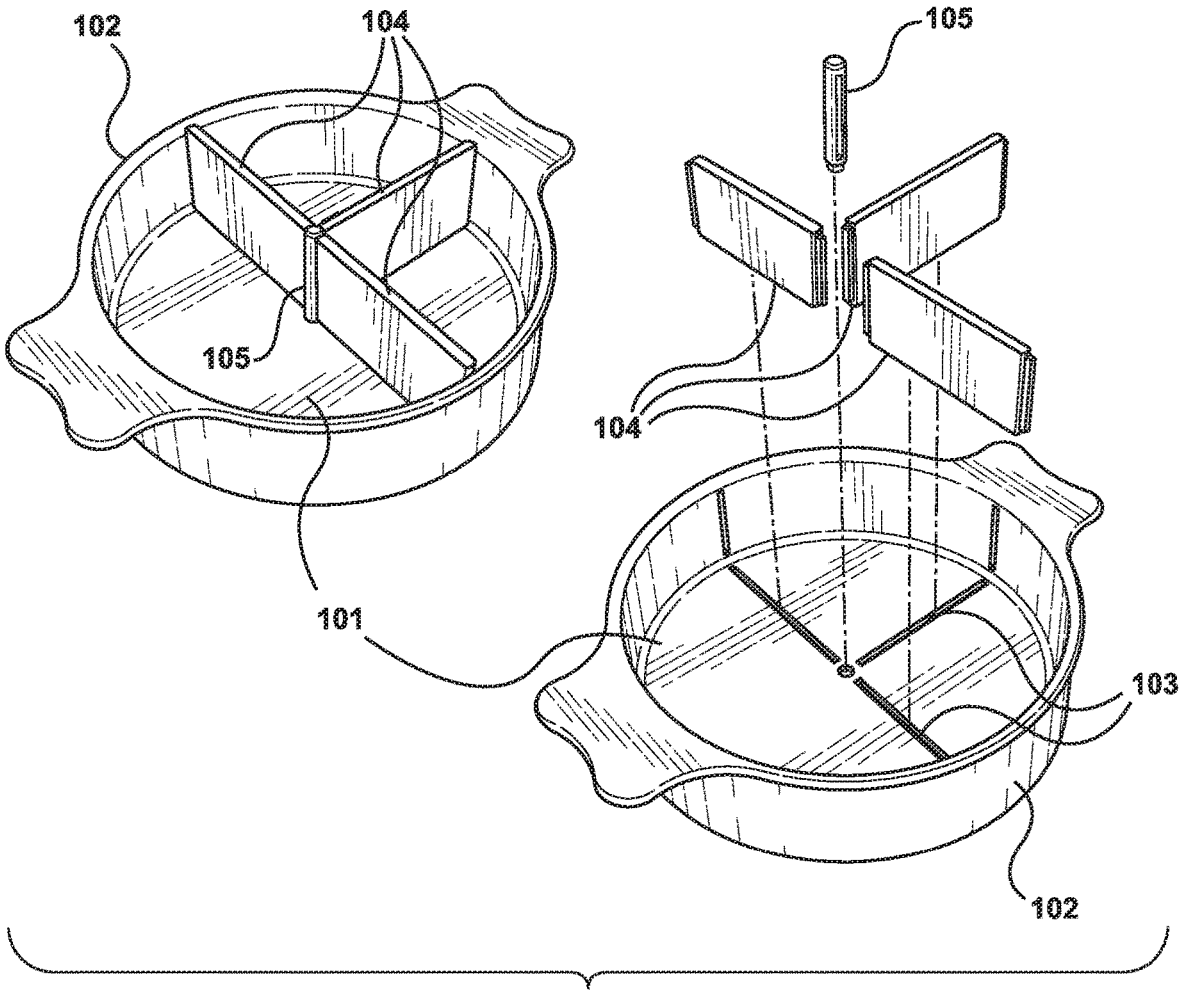
FIG. 1 shows a perspective view of an embodiment of the food storage container with removable dividers.

Reference is made herein to the attached drawings. Like reference numerals are used throughout the drawings to depict like or similar elements of the food storage container. For the purposes of presenting a brief and clear description of the present invention, a preferred embodiment will be discussed as used for the food storage container. The figures are intended for representative purposes only and should not be considered to be limiting in any respect.

Referring now to FIG. 1, there is shown a perspective view of an embodiment of the food storage container with removable dividers. The food storage container comprises a base 101. The base 101 may be of many different shapes. In one embodiment the base 101 may be circular. In another embodiment the base 101 may be rectangular.

The base 101 further comprises sidewalls 102 attached to it such that the sidewalls enclose a perimeter of the base 101. The sidewalls 102 are attached to the base 101 such that they rise from the base 101. The sidewalls 102 and the base 101 will form an interior volume of the container. The sidewalls 102 may have varying heights and thicknesses. In one embodiment the sidewall ends with a lip. In one embodiment the lip is tilted slightly outward away from the interior of the container.

The container further comprises tracks 103 located in the base 101. The tracks 103 are configured to allow for dividers 104 to be inserted into the tracks 103. In on embodiment there is further a center pin 105. The center pin 105 will add extra stability to the dividers 104. In one embodiment, the tracks 103 are recessed into the base 101. In another embodiment, the tracks 103 are created by raised portions attached to the base 101. While drawn representation of the tracks show tracks that are not continuous, in one embodiment the tracks are continuous from the base up the sidewall.

The dividers 104 are configured to partition the container into separate compartments when inserted into the tracks 103. Further, an edge of the dividers 104 fit into a center pin 105 to add stability and allow for an easier connection between the dividers 104. While the shown embodiment has the tracks 103 shown to divide the container divided in half with a first set of dividers followed by a second divider cutting the container into three sections, the tracks can be in any configuration. In one embodiment, the tracks 103 are additionally disposed in the sidewalls 102 of the container. In one embodiment, the dividers 104 are configured to remain in the tracks 103 via friction fit. In another embodiment, the dividers 104 snap into the tracks 103 of the base 101. In one embodiment the base of the dividers 104 is slightly wider than the top of the track. This allows the divider to snap into h tracks. In a further embodiment, the dividers 104 can create a waterproof seal once inserted between the lower edge of the dividers and the base 101. In one embodiment the waterproof seal is created using a rubber section on the base of the dividers. In another embodiment the tracks are continuous creating a seal. This will allow for liquids to be stored in the container as well.

Figure 2:
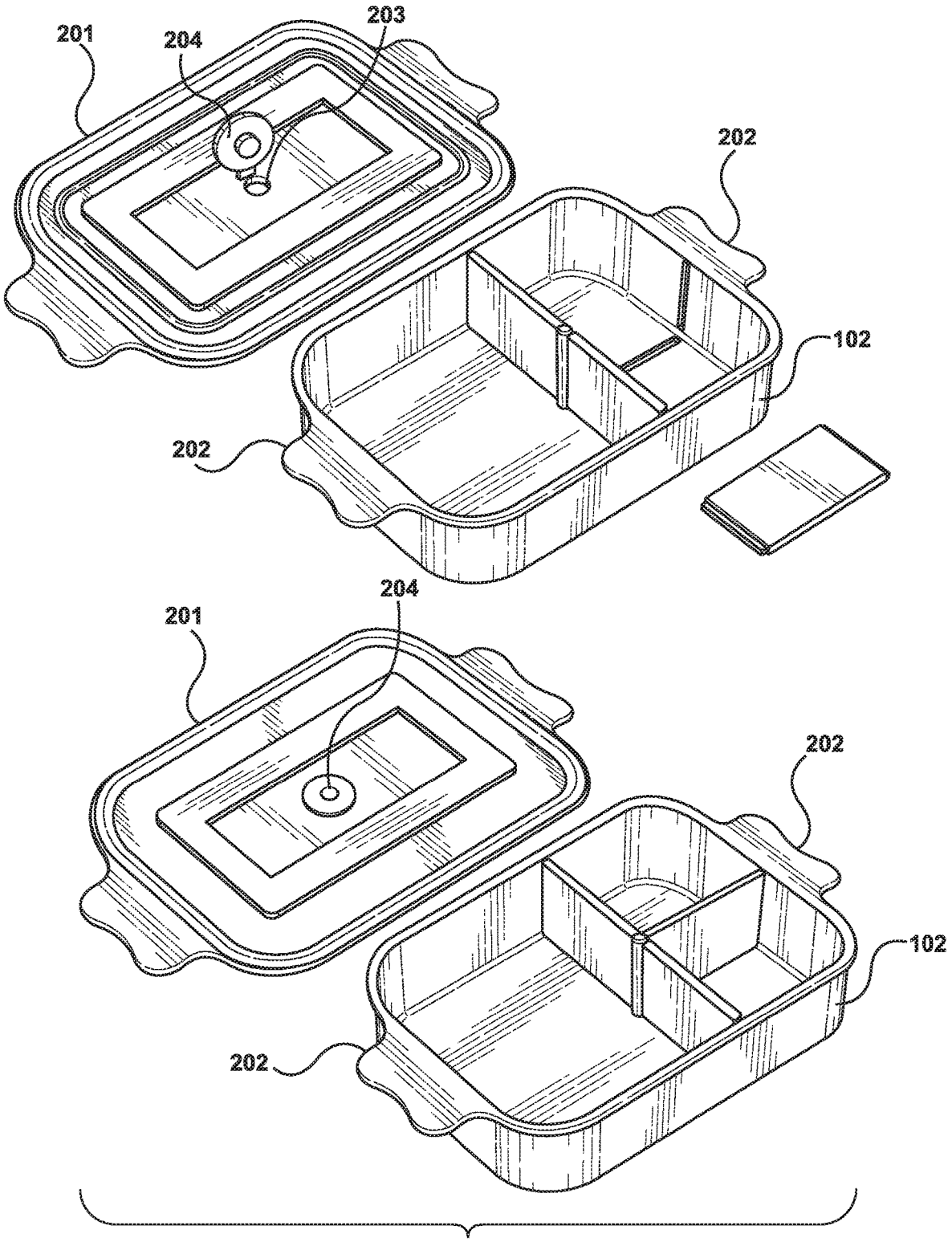
FIG. 2 shows a perspective view of an embodiment of food storage containers with lids.

Referring now to FIG. 2, there is shown a perspective view of an embodiment of food storage containers with lids. The container may be configured to accept a lid 201 thereon. The lid 201 is configured to removably secure to the top of the sidewalls 102, thereby forming a seal. In one embodiment, the seal formed between the sidewalls 102 and the lid is waterproof to prevent the container from leaking. In other embodiments, the lid 201 is configured to seal the individual compartments created by the dividers 104 by creating a seal with the dividers 104. In one embodiment the lid presses tight against the top of the dividers to create the seal. In another embodiment there is a rubber sealing member on the top of the divider. This will create a seal with the lid. In a further embodiment the lid contains tracks on the bottom side thereof. This will allow for the dividers to enter the lid and create a seal.

In some embodiments, the lid 201 further comprises a hole 203 located therein. The hole 203 is configured to provide ventilation through the lid 201, such that steam can escape therethrough during heating. In the illustrated embodiment, the hole 203 further comprises an opening tab 204. In one embodiment, the opening tab 204 is attached to the lid 201. In an embodiment, the opening tab 204 is configured to produce a waterproof seal within the hole 203.

In one embodiment, the container further comprises handles 202 placed thereon. In some embodiments, the handles 202 are disposed on opposing ends of the container. In one embodiment, the handles 202 are solid. This will allow the handles 202 to be stronger and easier to lift and move the container. The handles 202 should be able to pick the container up while it has food in it and remain sturdy enough such that the container will be lifted.

The container is made of food safe materials. This means that the container is made from FDA approved materials. In one embodiment, the container comprises a BPA-Free food safe plastic. In another embodiment the container comprises a food safe rubber. In further embodiments, the container is dishwasher safe. In another embodiment, the container is microwave safe.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food storage container, comprising:

a base with at least one sidewall extending upward therefrom defining an interior volume;

a plurality of tracks disposed in the base on the interior of the container, wherein the tracks are configured to accept at least one divider therein, dividers being configured to extend across the interior volume to define separate compartments;

a center pin removably securable within the base of the container;

a recess disposed in the base, wherein the recess removably secures a lower end of the center pin therein via frictional engagement;

wherein the center pin includes at least one slot on an exterior thereof;

wherein the slot is dimensioned to removably secure an edge of one of the plurality of dividers therein;

a plurality of handles extending from the at least one sidewall, wherein each handle of the plurality of handles is disposed between a top and a bottom of the sidewall.

2. The food storage container of claim 1, further comprising a lid configured to secure to a top of the at least one sidewall of the container.

3. The food storage container of claim 2, wherein the lid forms a waterproof seal when the lid is secured to the sidewall.

4. The food storage container of claim 3, wherein the lid forms a waterproof seal between the partitions when the lid is secured to the sidewall.

5. The food storage container of claim 2, wherein the container lid comprises a hole extending therethrough and an opening tab which is configured to selectively open or close to allow or prevent access to the interior of the container through the hole.

6. The food storage container of claim 2, further comprising a pair of secondary handles disposed on opposing sides of the lid.

7. The food storage container of claim 6, wherein the pair of secondary handles are aligned with the pair of handles when the lid is secured to the sidewall.

8. The food storage container of claim 1, wherein the container is made from plastic.

9. The food storage container of claim 1, wherein the tracks are configured to hold the dividers in place via friction.

10. The food storage container of claim 1, wherein the container is made from BPA-free food grade material.

11. The food storage container of claim 1, wherein the tracks are configured to hold the dividers in place via snap fit.

12. The food storage container of claim 1, wherein the container is dishwasher safe.

13. The food storage container of claim 1, wherein the container is microwave safe.

* * * * *